US010295129B2

(12) United States Patent
McWhirter

(10) Patent No.: US 10,295,129 B2
(45) Date of Patent: May 21, 2019

(54) METHOD AND APPARATUS FOR ORNAMENTAL LIGHT STRINGS

(71) Applicant: Timothy Ryan McWhirter, Magnolia, TX (US)

(72) Inventor: Timothy Ryan McWhirter, Magnolia, TX (US)

(73) Assignee: Timothy Ryan McWhirter, Magnolia, TX (US)

( * ) Notice: Subject to any disclaimer, the term of this patent is extended or adjusted under 35 U.S.C. 154(b) by 266 days.

(21) Appl. No.: 15/443,361

(22) Filed: Feb. 27, 2017

(65) Prior Publication Data

US 2018/0245751 A1 Aug. 30, 2018

(51) Int. Cl.

| | |
|---|---|
| ***F21S 4/10*** | (2016.01) |
| ***F21V 25/02*** | (2006.01) |
| ***H05B 33/00*** | (2006.01) |
| *F21V 3/02* | (2006.01) |
| *F21W 121/04* | (2006.01) |
| *F21V 19/04* | (2006.01) |

(52) U.S. Cl.

CPC ..... *F21S 4/10* (2016.01); *F21V 25/02* (2013.01); *H05B 33/00* (2013.01); *F21V 3/02* (2013.01); *F21V 19/04* (2013.01); *F21W 2121/04* (2013.01)

(58) Field of Classification Search

CPC ..... F21S 4/10; F21V 19/04; F21V 19/042; F21V 25/02; F21V 3/02; F21W 2121/04

See application file for complete search history.

(56) References Cited

U.S. PATENT DOCUMENTS

| | | | | |
|---|---|---|---|---|
| 4,727,449 | A | 2/1988 | Fleck | |
| 6,586,751 | B1 * | 7/2003 | Pichon | G01J 1/50 250/473.1 |
| 6,734,678 | B2 | 5/2004 | Frederick | |
| 7,276,911 | B2 | 10/2007 | Frederick et al. | |
| 7,391,161 | B2 | 6/2008 | Janning | |

(Continued)

FOREIGN PATENT DOCUMENTS

| | | | |
|---|---|---|---|
| EP | 1205192 A1 * | 5/2002 | A01M 1/2061 |

OTHER PUBLICATIONS

Nathan Chandler, How Thermochromic Ink Works, Tech | Other Gadgets, printed on Dec. 28, 2016, 12 pages, http://electronics.howstuffworks.com/gadgets/other-gadgets/thermochromic-ink.htm/.

(Continued)

*Primary Examiner* — Robert J May
*Assistant Examiner* — Leah Simone Macchiarolo
(74) *Attorney, Agent, or Firm* — King & Spalding LLP

(57) ABSTRACT

A system, method and apparatus for detecting a faulty bulb within an ornamental light string. The light string includes a plug at one end, a receptacle at an opposing end and a plurality of lamps in series arrangement coupled therebetween using an electrical wire. Each lamp includes a bulb, a socket coupled to the bulb, and a light source within the bulb that is electrically coupled to the electrical wire. The bulb includes a translucent cover coupled to a holder. The holder is removably coupled to the socket. The socket comprises a temperature-dependent color changing material, which can be thermochromic ink, which allows the outer surface of the socket to change colors depending upon its temperature thereby assisting in identifying a faulty bulb requiring replacement.

12 Claims, 8 Drawing Sheets

(56) References Cited

U.S. PATENT DOCUMENTS

| | | | | |
|---|---|---|---|---|
| 7,626,321 | B1 | 12/2009 | Gibboney, Jr. | |
| 7,781,979 | B2 | 8/2010 | Lys | |
| 9,491,826 | B2 | 11/2016 | Altamura et al. | |
| 9,500,719 | B2 | 11/2016 | Cherry et al. | |
| 2002/0195945 | A1* | 12/2002 | Gershen ..... | H05B 39/105 315/55 |

OTHER PUBLICATIONS

Julia Layton, How LED Light Bulbs Work, Science | Sustainable Technologies at Home, printed on Dec. 28, 2016, 8 pages, http://science.howstuffworks.com/environmental/green-tech/sustainable/led-light-bulb.htm.

Terry Ritter, Christmas Lights and How to Fix Them, Nov. 27, 2005, printed on Dec. 25, 2016, 9 pages, http://www.ciphersbyritter.com/RADELECT/LITES/XMSLITES.HTM.

Daniel Wood and Sara Gerrity, How Do Holiday Lights Work, Department of Energy,Dec. 16, 2015, printed on Dec. 28, 2016, 8 pages, https://energy.gov/articles/how-do-holiday-lights-work.

* cited by examiner

METHOD AND APPARATUS FOR ORNAMENTAL LIGHT STRINGS

TECHNICAL FIELD

Exemplary embodiments of the present disclosure relate generally to lighting solutions for decorative light strings, and more particularly to systems, methods, and apparatuses for visibly identifying which of one or more bulbs are faulty bulbs and require replacement within decorative light strings that have bulbs connected in series, including, but not limited to, light strings used in Christmas trees, including pre-strung or "pre-lit" artificial trees.

BACKGROUND

One of the most common uses of series-connected light strings, particularly of the commonly called "miniature" type, is for decoration and display purposes, particularly during Christmas time and other holidays. Such light strings are especially popular for the decoration of Christmas trees, both inside and outside commercial, industrial and residential buildings, trees and shrubbery, alongside building or house roof edges, and the like.

Probably the most popular light set currently available on the market comprises one or more strings of fifty (50) miniature light bulbs each. Each bulb typically has an operating voltage of about 2.4 volts, and the filaments of each 50-bulb string are connected in an electrical series circuit arrangement. If overall light sets of more than that which is available are desired, the common practice is to provide a plurality of 50-bulb strings, with the bulbs in each string connected in electrical series, and connect them in either a parallel circuit arrangement, in a series circuit arrangement, or in a combination of parallel and series arrangement.

As the bulbs in each string are connected in series, when a single bulb, or filament within the bulb, fails to illuminate for any reason, the whole string fails to light, and it is very frustrating and time consuming to locate and replace a defective bulb or bulbs. Usually many bulbs have to be checked in order to find the failed bulb. In fact, in many instances, the frustration and time-consuming efforts are so great as to cause one to completely discard and replace the non-working string with a new string. Replacement, however, does not offer a practical solution if the lights are already on a decorated Christmas tree where removal could cause damage to the ornaments, or on wire frame yard decorations where the lights have many clips and wire ties holding them to the frame, or where they are fixedly coupled within a pre-strung or "pre-lit" Christmas tree.

Light bulb manufacturers have also attempted to solve the problem of light section or string failures caused by single bulb failure by designing each light bulb in the string in a manner whereby the filament in each light bulb is shorted by a shunting device, commonly referred to as a shunt, whenever it burns out for any reason, thereby preventing an open circuit condition from occurring in the socket of the burned-out bulb. The shunt is typically positioned directly within the glass envelope, or translucent cover, of each bulb in the string, making the effectiveness of the shunt depend on the presence at all times of a bulb within each of the bulb sockets in the string. In operation, the shunt provides an alternate path through which electric current will flow in the event of filament failure. After bulb failure and as long as the bulb remains in the string, the shunt allows current to continue to flow through the bulb, thereby preventing the failure of the entire series section of the light string. The shunt is typically made at least in part of a material that is non-conductive as long as the bulb filament is operative, but becomes conductive whenever the filament fails. In normal operation, current will flow through the filament to produce incandescent light within the translucent cover. When the filament breaks, however, the increased voltage differential across the bulb lead wires causes the non-conductive material to break down so that current continues to flow through the shunt in the failed bulb to the other bulbs in series therewith. That is, each shunt is inoperative unless and until it is subjected to substantially the full output voltage of the power source. When the bulb filament associated with a shunt fails, that shunt is subjected to the full voltage of the power supply, which renders that shunt operative to bypass the failed filament. However, in actual practice, it has been found that such short circuiting feature within the bulb does not function with a high degree of reliability and also does not always operate in the manner intended, and thus the failure of a single bulb still often extinguishes the entire string.

SUMMARY

An exemplary embodiment includes an ornamental light string. The ornamental light string includes a plug positioned at one end of a light string, a receptacle positioned at an opposing end of the light string, a wire extending from and electrically coupling the plug to the receptacle, and a plurality of lamps positioned along and electrically coupled to the wire. At least a portion of the plurality of lamps are arranged in series arrangement along the wire. Each lamp includes a bulb and a socket. The bulb includes a translucent cover, a holder coupled to the translucent cover at one end, and a light source positioned within the translucent cover and electrically coupled to the wire. The light source is capable of emitting light through the translucent cover. The socket includes a cavity extending from a top end towards a bottom end. The socket is coupled to the bulb wherein at least a portion of the holder is removably positioned within the cavity. The socket includes a temperature-dependent color changing material being at least partially exposed on the outer surface of the socket. The temperature-dependent color changing material visibly changes color on at least the outer surface of the socket when the temperature of the socket changes.

An exemplary embodiment includes a lamp. The lamp includes a socket and a bulb. The socket includes a cavity extending from a top end towards a bottom end. The socket includes a temperature-dependent color changing material being at least partially exposed on the outer surface of the socket. The socket also includes a first electrical terminal and a second electrical terminal positioned along an interior surface of the socket within the cavity. The bulb includes a translucent cover, a holder coupled to the translucent cover at one end, and a light source positioned within the translucent cover and electrically coupled to the first and second electrical terminals when at least a portion of the holder is removably positioned within the cavity and coupled to the socket. The light source is capable of emitting light through the translucent cover. The temperature-dependent color changing material visibly changes color on at least the outer surface of the socket when the temperature of the socket changes.

An exemplary embodiment includes a method for assembling an ornamental light string that includes providing a plug and a receptacle, electrically coupling the plug to the receptacle using an insulated wire, and electrically connecting a plurality of lamps along the insulated wire where at least a portion of the plurality of lamps are positioned in a series arrangement with one another. Each lamp includes a socket and a bulb. The socket includes a cavity extending from a top end towards a bottom end. The socket includes a temperature-dependent color changing material being at least partially exposed on the outer surface of the socket. The socket also includes a first electrical terminal and a second electrical terminal positioned along an interior surface of the socket within the cavity where each of the first and second electrical terminals is electrically coupled to the insulated wire. The bulb is coupled to the socket and includes a translucent cover, a holder coupled to the translucent cover at one end, and a light source positioned within the translucent cover and electrically coupled to the first and second electrical terminals when at least a portion of the holder is removably positioned within the cavity and coupled to the socket. The light source is capable of emitting light through the translucent cover. The temperature-dependent color changing material visibly changes color on at least the outer surface of the socket when the temperature of the socket changes.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1A:
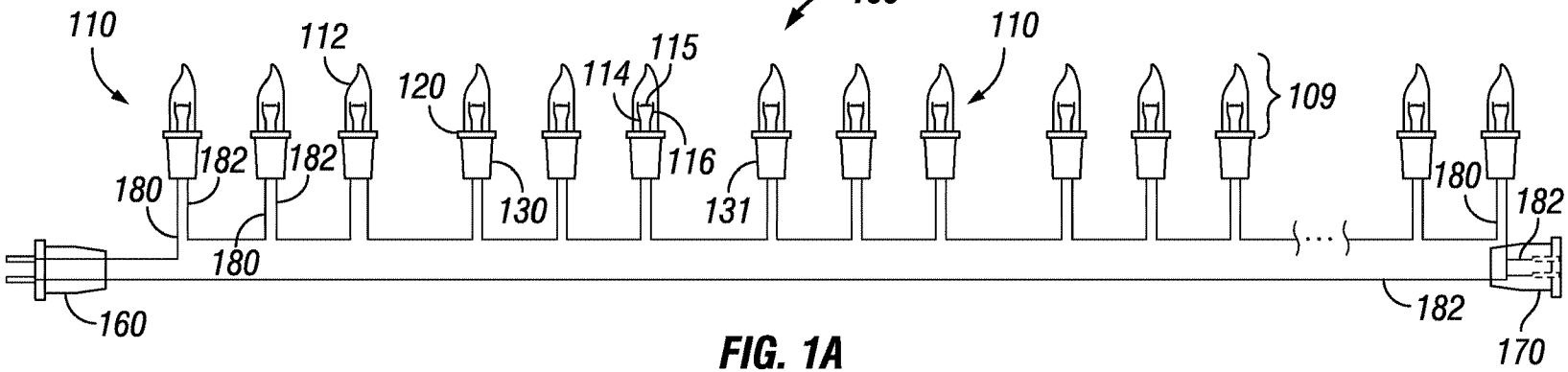
FIG. 1A (Prior Art)
FIG. 1A is a schematic view of an ornamental light string having a plurality of lamps coupled in series with one another and wherein the light string is not coupled to a power source in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present disclosure is directed to lighting solutions for decorative light strings, and more particularly to systems, methods, and apparatuses for visibly identifying which of one or more bulbs are faulty bulbs and require replacement within decorative light strings that have bulbs connected in series, including, but not limited to, light strings used in Christmas trees, including pre-strung or "pre-lit" artificial trees. The disclosure is better understood by reading the following description of non-limiting, exemplary embodiments with reference to the attached drawings, wherein like, but not necessarily the same or identical, parts of each of the figures are identified by like reference characters, and which are briefly described as follows. Further, the term "light string" refers to plural spaced-apart lamps interconnected in an electrical series by insulated electrical wiring. The term "lamp" refers to the combination of a translucent cover, holder, and socket. The term "bulb" refers to the combination of the translucent cover and the holder.

FIG. 1A is a schematic view of an ornamental light string 100 having a plurality of lamps 110 coupled in series with one another and wherein the light string 100 is not coupled to a power source (not shown) in accordance with the prior art. The ornamental light string 100 includes a plug 160 at one end, a receptacle 170 at an opposing end, and a plurality of lamps 110 therebetween, each electrically coupled to one another in series arrangement by two insulated wires 180, 182. The plug 160 is coupleable to a power source (not shown), while the receptacle 170 is coupleable to another plug 160 of a different ornamental light string 100 to increase the number of lamps 110 present. Insulated wire 180 supplies electrical current to the lamp 110, while insulated wire 182 allows the electrical current to exit the lamp 110 and proceed to the next adjacent lamp 110 in series or to both the electrical receptacle 170 and the plug 160 if the lamp 110 is the last lamp 110 in the series 100. When insulated wire 182 proceeds back to the plug 160, the insulated wires 180, 182 complete the electrical circuit of the ornamental light string 100 when the plug 160 is coupled to the power source (not shown). Although FIG. 1A shows the light string 100 having a plurality of lamps 110 electrically coupled to one another in a series arrangement, the lamps 110 are coupled to one another in either a series arrangement, a parallel arrangement, or a combination of both arrangements according to other exemplary embodiments. Additionally, although light string 100 includes a receptacle 170 at the opposing end of the light string 100, the receptacle 170 is optional and may not be present in all exemplary embodiments.

Each lamp 110 includes a translucent cover 112, a holder 120, and a socket 130. The translucent cover 112 encapsulates a first Dumet wire 114, a second Dumet wire 116, and a filament 115 extending from the end of the first Dumet wire 114 to the end of the second Dumet wire 116. The translucent cover 112 is fabricated using a transparent material thereby allowing light to pass through from the interior of the translucent cover 112 to an exterior side of the translucent cover 112. The translucent cover 112 may be clear according to some exemplary embodiments or may be tinted a certain color according to other exemplary embodiments. The translucent cover 112 is fabricated from a glass material, a plastic material, or any other suitable material that allows light to travel through it. Although the translucent cover 112 is illustrated having a certain shape, the shape of the translucent cover 112 may be different according to other exemplary embodiments.

The holder 120 is coupled to the translucent cover 112 at its top end. The holder 120 also allows the first Dumet wire 114 and the second Dumet wire 116 to pass through the interior of the holder 120 and exit the bottom end of the holder 120. The first Dumet wire 114 and the second Dumet wire 116 are folded about the bottom end of the holder 120 and upward along the outer side edges of the holder 120. The holder 120 allows for these Dumet wires 114, 116 to extend from the holder 120 into the interior of the translucent cover 112. The holder 120 is fabricated from a non-conductive material, such as a plastic material, a polymer material, or any other suitable non-conductive material, especially with respect to any exposed areas of the holder 120 once the holder 120 is inserted and secured into a cavity 333 (FIG. 3) formed in the socket 130. The holder 120 is generally formed using a mold (not shown) into a desired shape that has an exterior shape that is complimentary to the shape of the cavity 333 (FIG. 3) formed within the socket 130. According to some exemplary embodiment, the holder 120 is secured within the socket 130 by friction-fit; however, the holder 120 is secured within the socket 130 by other known methods in other exemplary embodiments. The combination of the holder 120 and the translucent cover 112, once coupled together, is referred to as a bulb 109. Bulb 109 is removable from the socket 130.

The socket 130 also is fabricated from a non-conductive material, such as a plastic material, a polymer material, or any other suitable non-conductive material, especially with respect to any exposed areas of the socket 130 once the holder 120 is inserted and secured into the cavity 333 (FIG. 3) formed in the socket 130. The socket 130 is formed with a cavity 333 (FIG. 3) having a shape that is complimentary to the exterior shape of the holder 120. The cavity 333 (FIG. 3) extends from a top end of the socket 130 and extends toward a bottom end of the socket 130 adjacent to where the insulated wires 180, 182 enter into and exit from the bottom end of the socket 130. The socket 130 is generally formed using a mold (not shown) into a desired shape.

Figure 3:
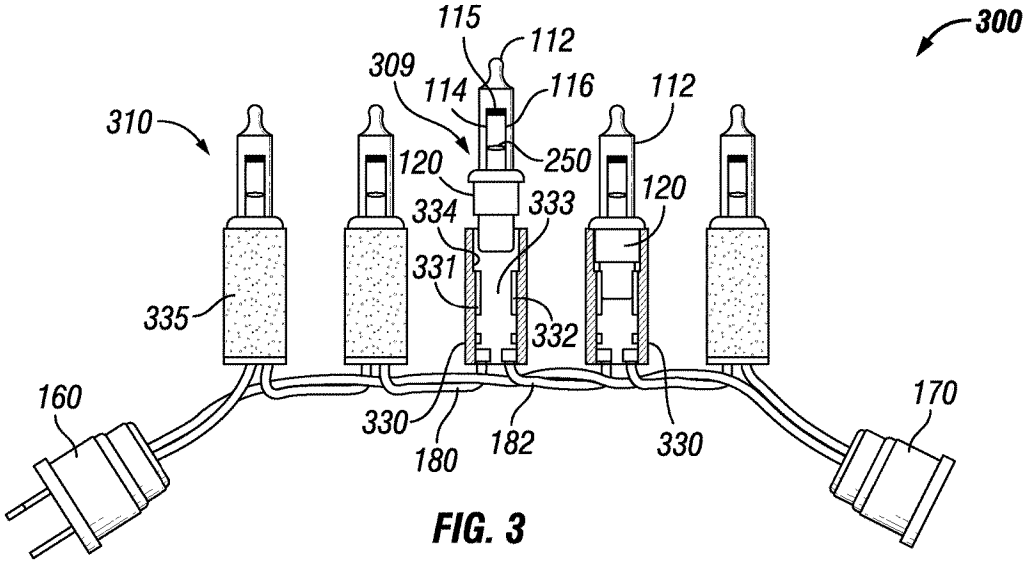
FIG. 3 shows a perspective and schematic view of an ornamental light string with two bulbs of the string having sockets partially cut away and one of these having the bulb, which includes translucent cover and holder, being removed from the partially cut away socket and wherein the sockets comprise thermochromic ink in accordance with an exemplary embodiment of the present invention.

The details on the electrical connectivity from the insulated wires 180, 182 to the filament 115 is detailed with respect to FIG. 3. Although FIG. 3 illustrates and details one example for providing the electrical connectivity that is applicable for each lamp 110, the details of the electrical connectivity may be different in other exemplary embodiments and the description with respect to the electrical connectivity in accordance with FIG. 3 is not to be limiting in any respect.

According to FIG. 1A, the ornamental light string 100 is not coupled to a power source (not shown) and therefore none of the filaments 115 are energized and hence none of the lamps 110 are lit. The sockets 130 are all a first color 131. According to some exemplary embodiments, the first color 131 is a green color or a white color, however, the first color 131 may be any other color.

Figure 1B:
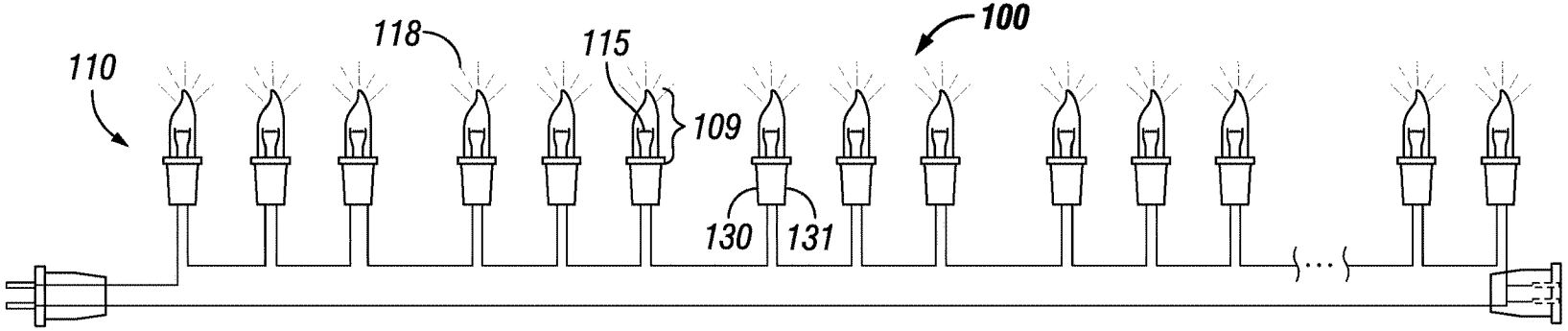
FIG. 1B (Prior Art)
FIG. 1B is a schematic view of the ornamental light string of FIG. 1A wherein the light string is coupled to a power source in accordance with the prior art.

FIG. 1B is a schematic view of the ornamental light string 100 of FIG. 1A wherein the light string 100 is coupled to a power source (not shown) in accordance with the prior art. According to FIG. 1B, all filaments 115 within each bulb 109 are working properly. According to FIG. 1B, the light string 100 is electrically coupled to the power source (not shown) and each of the filaments 115 within each of the bulbs 109 are energized, thereby causing each lamp 110 to be lit 118. The sockets 130 remain the first color 131.

Figure 1C:
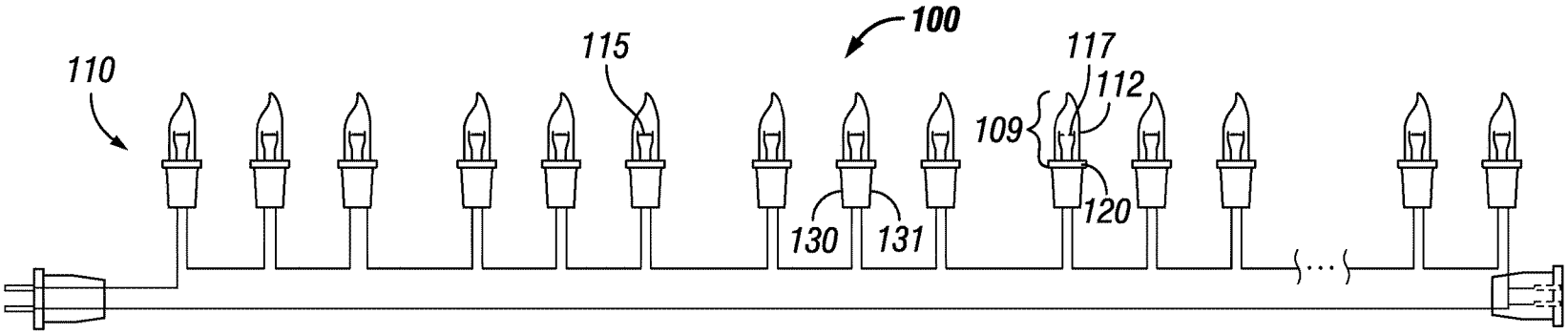
FIG. 1C (Prior Art)
FIG. 1C is a schematic view of the ornamental light string of FIG. 1A wherein a broken filament in one of the bulbs of the light string is present and wherein the light string is coupled to a power source in accordance with the prior art.

FIG. 1C is a schematic view of the ornamental light string 100 of FIG. 1A wherein a broken filament 117 in one of the bulbs 109 of the light string 100 is present and wherein the light string 100 is coupled to a power source (not shown) in accordance with the prior art. According to FIG. 1C, all filaments 115 within each bulb 109 are working properly except for the broken filament 117 in one of the bulbs 109. According to FIG. 1C, the light string 100 is electrically coupled to a power source (not shown) and each of the filaments 115 along with the broken filament 117 are not energized since the electrical circuit is broken at the point of the broken filament 117. The current is not able to pass through to the filaments 115 positioned downstream of the broken filament 117. In particular, the current flows through each filament 115 positioned upstream of the broken filament 117, but does not flow through the broken filament 117 or any of the filaments 115 positioned downstream of the broken filament 117. Since the circuit is broken, none of the lamps 110 are lit. All the sockets 130 remain the first color 131. According to the light string 100 of the prior art, it would be difficult to determine which lamp 110 has the broken filament 117 and requires replacement of the bulb 109, which includes translucent cover 112 and holder 120.

Figure 2A:
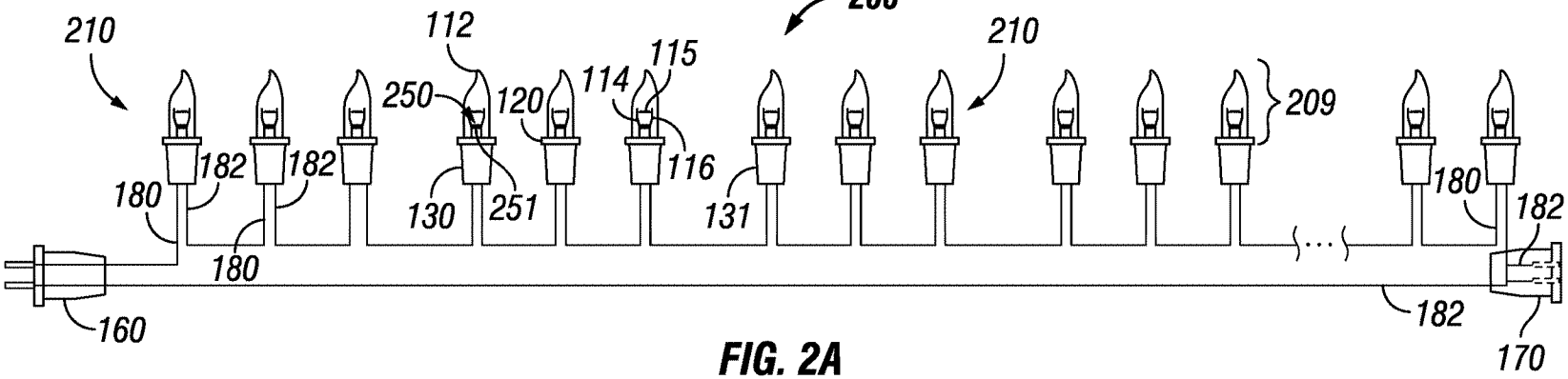
FIG. 2A (Prior Art)
FIG. 2A is a schematic view of an ornamental light string having a plurality of lamps coupled in series with one another wherein each lamp includes a shunting device within each bulb and wherein the light string is not coupled to a power source in accordance with the prior art.

FIG. 2A is a schematic view of an ornamental light string 200 having a plurality of lamps 210 coupled in series with one another wherein each lamp 210 includes a shunting device 250 within each bulb 209 and wherein the light string 200 is not coupled to a power source (not shown) in accordance with the prior art. The ornamental light string 200 is similar to the ornamental light string 100 of FIG. 1A, except that the plurality of lamps 210 include a shunting device 250 within each of the bulbs 209. The ornamental light string 200 includes a plug 160 at one end, a receptacle 170 at an opposing end, and a plurality of lamps 210 therebetween, each electrically coupled to one another in series arrangement by two insulated wires 180, 182. The plug 160 is coupleable to a power source (not shown), while the receptacle 170 is coupleable to another plug 160 of a different ornamental light string 200, or light string 100 (FIG. 1A), to increase the number of lamps 210, or a mixture of lamps 110, 210, that are present. Insulated wire 180 supplies electrical current to the lamp 210, while insulated wire 182 allows the electrical current to exit the lamp 210 and proceed to the next adjacent lamp 210 in series or to both the electrical receptacle 170 and the plug 160 if the lamp 210 is the last lamp 210 in the series. When insulated wire 182 proceeds back to the plug 160, the insulated wires 180, 182 complete the electrical circuit of the ornamental light string 200 when the plug 160 is coupled to the power source (not shown). Although FIG. 2A shows the light string 200 having a plurality of lamps 210 electrically coupled to one another in a series arrangement, the lamps 210 are coupled to one another in either a series arrangement, a parallel arrangement, or a combination of both arrangements according to other exemplary embodiments. Additionally, although light string 200 includes a receptacle 170 at the opposing end of the light string 200, the receptacle 170 is optional and may not be present in all exemplary embodiments.

Each lamp 210 includes a translucent cover 112, a holder 120, and a socket 130. The translucent cover 112 encapsulates a first Dumet wire 114, a second Dumet wire 116, a filament 115 extending from the end of the first Dumet wire 114 to the end of the second Dumet wire 116, and the shunting device 250 also extending from the first Dumet wire 114 to the second Dumet wire 116 such that the shunting device 250 is parallel to the filament 115 and is exposed to the electrical current prior to the filament 115 within that bulb 209. The shunting device 250 is an insulated wire that does not pass electrical current while the filament 115 is operational. Once the filament 115 becomes inoperable, the electrical current causes the insulation 251 present on the shunting device 250 to burn off thereby allowing electrical current to pass through the shunting device 250 since the electrical current can no longer pass through the filament 115 when broken. This shunting device 250 allows the electrical circuit to be complete even though the filament 115 is inoperable. The translucent cover 112 is fabricated using a transparent material thereby allowing light to pass through from the interior of the translucent cover 112 to an exterior side of the translucent cover 112. The translucent cover 112 may be clear according to some exemplary embodiments or may be tinted a certain color according to other exemplary embodiments. The translucent cover 112 is fabricated from a glass material, a plastic material, or any other suitable material that allows light to travel through it. Although the translucent cover 112 is illustrated having a certain shape, the shape of the translucent cover 112 may be different according to other exemplary embodiments.

The holder 120 is coupled to the transparent cover 112 at its top end. The holder 120 also allows the first Dumet wire 114 and the second Dumet wire 116 to pass through the interior of the holder 120 and exit the bottom end of the holder 120. The first Dumet wire 114 and the second Dumet wire 116 are folded about the bottom end of the holder 120 and upward along the outer side edges of the holder 120. The holder 120 allows for these Dumet wires 114, 116 to extend from the holder 120 into the interior of the transparent cover 112. The holder 120 is fabricated from a non-conductive material, such as a plastic material, a polymer material, or any other suitable non-conductive material, especially with respect to any exposed areas of the holder 120 once the holder 120 is inserted and secured into a cavity 333 (FIG. 3) formed in the socket 130. The holder 120 is generally formed using a mold (not shown) into a desired shape that has an exterior shape that is complimentary to the cavity 333 (FIG. 3) formed within the socket 130. According to some exemplary embodiment, the holder 120 is secured within the socket 130 by friction-fit; however, the holder 120 is secured within the socket 130 by other known methods in other exemplary embodiments. The combination of the holder 120 and the translucent cover 112, once coupled together, is referred to as a bulb 209. Bulb 209 is removable from the socket 130.

The socket 130 also is fabricated from a non-conductive material, such as a plastic material, a polymer material, or any other suitable non-conductive material, especially with respect to any exposed areas of the socket 130 once the holder 120 is inserted and secured into the cavity 333 (FIG. 3) formed in the socket 130. The socket 130 is formed with a cavity 333 (FIG. 3) having a shape that is complimentary to the exterior shape of the holder 120. The cavity 333 (FIG. 3) extends from a top end of the socket 130 and extends toward a bottom end of the socket 130 adjacent to where the insulated wires 180, 182 enter into and exit from the bottom end of the socket 130. The socket 130 is generally formed using a mold (not shown) into a desired shape.

The details on the electrical connectivity from the insulated wires 180, 182 to the filament 115 is detailed with respect to FIG. 3. Although FIG. 3 illustrates and details one example for providing the electrical connectivity that is applicable for each lamp 210, the details of the electrical connectivity may be different in other exemplary embodiments and the description with respect to the electrical connectivity in accordance with FIG. 3 is not to be limiting in any respect.

According to FIG. 2A, the ornamental light string 200 is not coupled to a power source (not shown) and therefore none of the filaments 115 are energized and hence none of the lamps 210 are lit. The sockets 130 are all a first color 131. According to some exemplary embodiments, the first color 131 is a green color or a white color, however, the first color may be any other color.

Figure 2B:
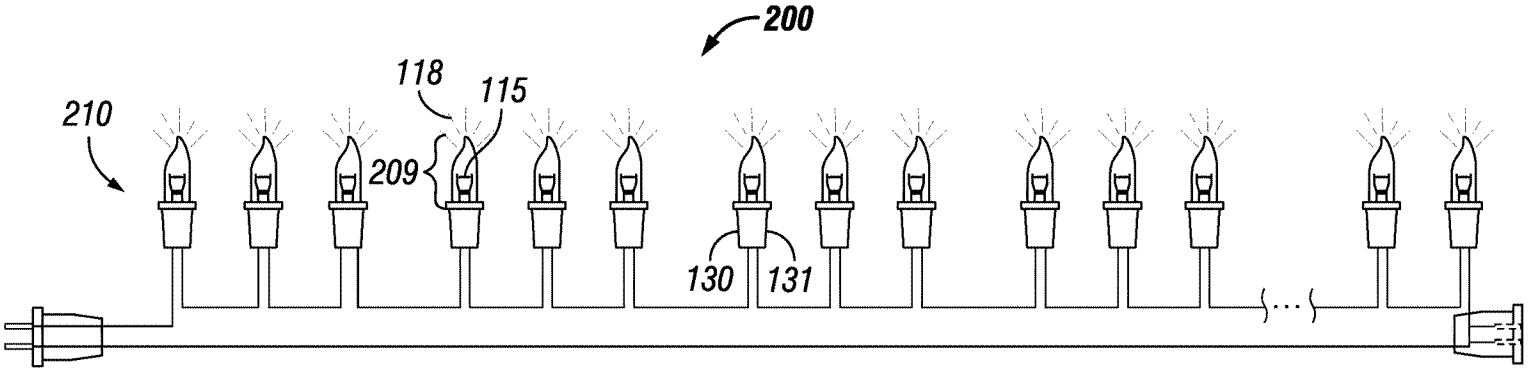
FIG. 2B (Prior Art)
FIG. 2B is a schematic view of the ornamental light string of FIG. 2A wherein the light string is coupled to a power source in accordance with the prior art.

FIG. 2B is a schematic view of the ornamental light string 200 of FIG. 2A wherein the light string 200 is coupled to a power source (not shown) in accordance with the prior art. According to FIG. 2B, all filaments 115 within each bulb 209 are working properly. According to FIG. 2B, the light string 200 is electrically coupled to the power source (not shown) and each of the filaments 115 within each of the bulbs 209 are energized, thereby causing each lamp 210 to be lit 118. The sockets 130 remain the first color 131.

Figure 2C:
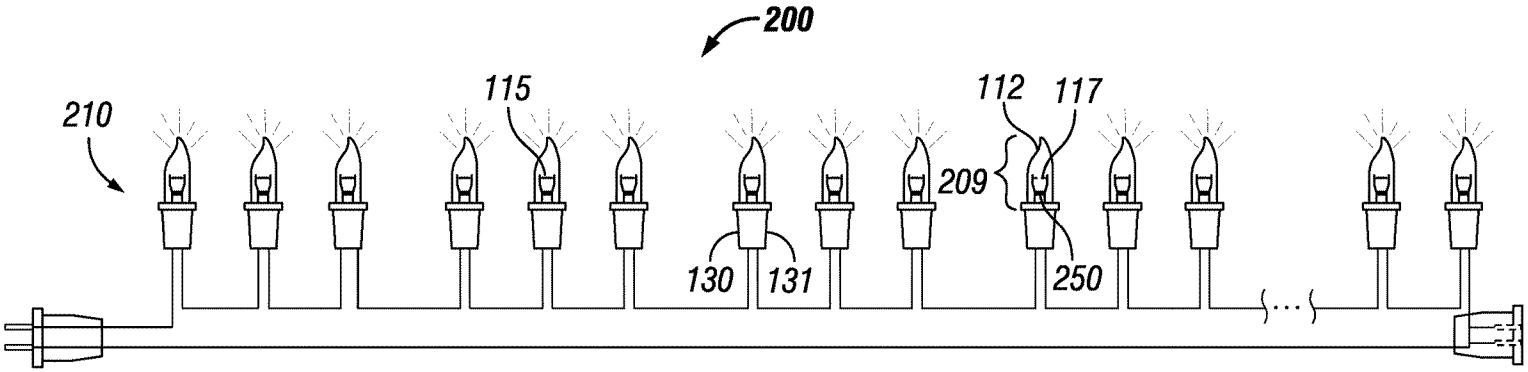
FIG. 2C (Prior Art)
FIG. 2C is a schematic view of the ornamental light string of FIG. 2A wherein a broken filament in one of the bulbs of the light string is present and the shunting device within that bulb having the broken filament is operable and wherein the light string is coupled to a power source in accordance with the prior art.

FIG. 2C is a schematic view of the ornamental light string 200 of FIG. 2A wherein a broken filament 117 in one of the bulbs 209 of the light string 200 is present and the shunting device 250 within that bulb 209 having the broken filament 117 is operable and wherein the light string 200 is coupled to a power source (not shown) in accordance with the prior art. According to FIG. 2C, all filaments 115 within each bulb 209 are working properly except for the broken filament 117 in one of the bulbs 209. According to FIG. 2C, the light string 200 is electrically coupled to a power source (not shown) and each of the filaments 115, except for the broken filament 117, are energized since the electrical circuit is complete due to the shunting device 250 being operable within the bulb 209 having the broken filament 117. The current is able to pass through to the filaments 115 positioned upstream of the broken filament 117. Once at the lamp 210 having the broken filament 117, although the current is not able to pass through the broken filament 117, the electrical current is able to by-pass the broken filament 117 via the shunting device 250 within the bulb 209 having the broken filament 117. The current is then able to flow through each filament 115 positioned downstream of the broken filament 117. Since the circuit is complete due to the shunting device 250 being operable within the lamp 210 having the broken filament 117, all of the lamps 210 are lit except for the lamp 210 having the broken filament 117. All the sockets 130 remain the first color 131. According to the light string 200 of the prior art, it would be easy to determine which lamp 210 has the broken filament 117 and requires replacement of the bulb 209, which includes translucent cover 112 and holder 120, but only when the shunting device 250 is operational. However, in most cases, shunting devices 250 do not operate as intended or often fail. This scenario is described in further detail with respect to FIG. 2D below.

Figure 2D:
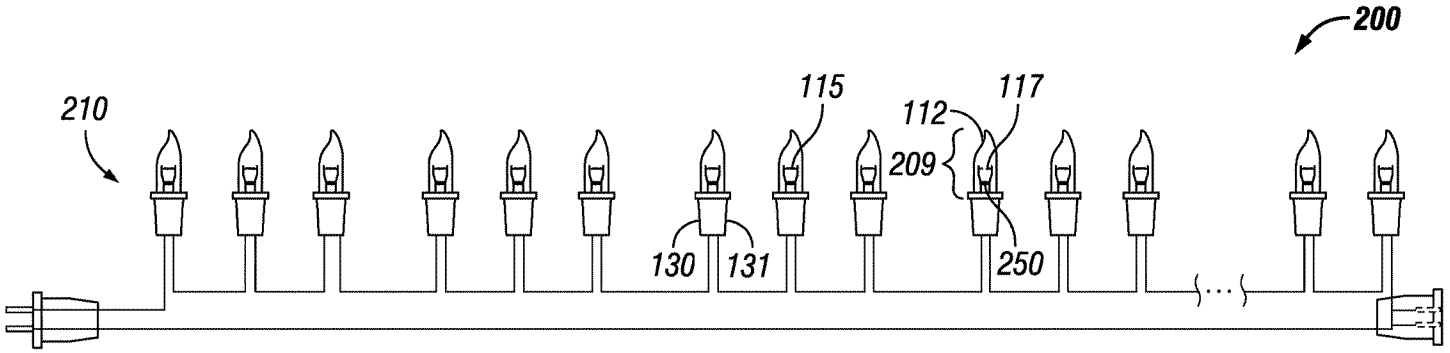
FIG. 2D (Prior Art)
FIG. 2D is a schematic view of the ornamental light string of FIG. 2A wherein a broken filament in one of the bulbs of the light string is present and the shunting device within that bulb having the broken filament is inoperable and wherein the light string is coupled to a power source in accordance with the prior art.

FIG. 2D is a schematic view of the ornamental light string 200 of FIG. 2A wherein a broken filament 117 in one of the bulbs 209 of the light string 200 is present and the shunting device 250 within that bulb 209 having the broken filament 117 is inoperable and wherein the light string 200 is coupled to a power source (not shown) in accordance with the prior art. According to FIG. 2D, all filaments 115 within each bulb 209 are working properly except for the broken filament 117 in one of the bulbs 209. According to FIG. 2D, the light string 200 is electrically coupled to a power source (not shown) and each of the filaments 115 along with the broken filament 117 are not energized since the electrical circuit is broken at the point of the broken filament 117 and since the shunting device 250 also is inoperable within the bulb 209 having the broken filament 117. The current is not able to pass through to the filaments 115 positioned downstream of the broken filament 117 since there is a broken filament 117 and also an inoperable shunting device 250 within the bulb 209 having the broken filament 117. In particular, the current flows through each filament 115 positioned upstream of the broken filament 117, but does not flow through the broken filament 117 or any of the filaments 115 positioned downstream of the broken filament 117. Since the circuit is broken, none of the lamps 210 are lit. All the sockets 130 remain the first color 131. According to the light string 200 of the prior art, it would be difficult to determine which lamp 210 has the broken filament 117 and requires replacement of the bulb 209, which includes the translucent cover 112 and holder 120, when the shunting device 250 within the bulb 209 having the broken filament 117 is inoperable.

FIG. 3 shows a perspective and schematic view of an ornamental light string 300 with two bulbs 309 of the string 300 having associated sockets 330 partially cut away and one of these having the bulb 309, which includes translucent cover 112 and holder 120, being removed from the partially cut away socket 330 and wherein the sockets 330 comprise thermochromic ink 335 in accordance with an exemplary embodiment of the present invention. The ornamental light string 300 includes a plurality of lamps 310 connected in series with one another between a plug 160 and a receptacle 170. According to FIG. 3, one of the lamps 310, the middle one, includes a translucent cover 112, a holder 120, and a socket 330, wherein the bulb 309, which includes translucent cover 112 and holder 120, portion of the lamp 310 is removed from the socket 330. Adjacent to that lamp 310 is another lamp 310, wherein the bulb 309 is shown seated in socket 330, with socket 330 shown in cross-section. Two insulated electrical wires, a first insulated wire 180 and a second insulated wire 182, extend into socket 330 from the adjacent lamps 310 in the series of lamps 310 of the light string 300. Translucent cover 112 is a partially evacuated transparent housing with a filament 115 connected between the ends of a first Drumet wire 114 and an opposing second Dumet wire 116 inside translucent cover 112. Also, a shunting device 250, as described above with respect to FIG. 2A, is coupled in parallel to the filament 115 and extends between the first Dumet wire 114 and the second Dumet wire 116. The shunting device 250 operates in the same manner as described above with respect to FIGS. 2A-2D. Dumet wires 114, 116 extend from the interior of bulb 309 to its exterior and through two spaced-apart holes (not shown) formed in holder 120. Once the Drumet wires 114, 116 emerge from the holes (not shown) in holder 120, Dumet wires 114, 116 are folded back against the sides of holder 120 in order to be in position along the sides of holder 120 so as to make contact with a first electrical terminal 331 and an opposing second electrical terminal 332. The first and second electrical terminals 331, 332 are coupled on opposing sides of the interior wall 334 of socket 330. The first and second Dumet wires 114, 116 are electrically coupled to the first and second electrical terminals 331, 332, respectively, as holder 120 is slid into and coupled to socket 330.

Within socket 330, first and second electrical terminals 331, 332 are in electrical contact with first and second insulated wires 180, 182, respectively. When holder 120 is seated in socket 330, Dumet wires 114, 116 also contact first and second terminals 331, 332, both physically and electrically, thereby allowing, when first and second insulated wires 180, 182 are energized, the flowing of an electrical current in a first conductive path through first and second terminals 331, 332, first and second Dumet wires 114, 116, and filament 115. In the event that filament 115 is broken, the current would flow through the shunting device 250 thereby maintaining the circuit as being closed, or complete. In the event that both the filament 115 and the shunting device 250 were rendered inoperable, the current would not flow through that lamp 310 as the circuit would be open.

According to FIG. 3 and other exemplary embodiments, the socket 330 includes a temperature-dependent color changing material 335, such as thermochromic ink 335, which allows the socket 330 to change colors when the temperature of the socket 330 changes, either when the socket 330 heats up or cools down. The temperature-dependent color changing material 335 is at least partially exposed on the outer surface of the socket 330 and visibly changes colors on at least the outer surface of the socket 330 when the temperature of the socket 330 changes color. Thermochromic ink 335 takes advantage of thermochromism, which refers to materials that change their hues in response to temperature fluctuations. There are two major categories of thermochromic inks 335, thermochromatic liquid crystals (TLCs) and leuco dyes.

TLCs are dynamic and exhibit different colors in response to temperature changes. At lower temperatures, these liquid crystals are mostly in a solid, crystalline form. In this low temperature state, TLCs may not reflect much light at all, thereby appearing black. As the temperature increases little by little, the TLCs shift from black to just about every color of the rainbow. This color change happens because as the temperature rises, spacing between the crystals changes, and hence, the crystals reflect light differently. Liquid crystals are microencapsulated into billions of tiny capsules that are just a few microns in size. This encapsulation process offers some protection for the TLCs and maintains their thermochromic properties.

Leuco dyes also are microencapsulated into tiny droplets that are only about 3 to 5 microns in size, which prevents them from reacting with or being damaged by other chemicals. Usually, leuco dyes are colored when they're at a cool temperature, and then as they heat up, the leuco dyes become transparent to reveal any colors, patterns, or words that may be printed on the underlying layer of ink. In some products, leuco dyes may be blended with another color so that as the temperature changes, a two-tone effect occurs. The tiny capsules of leuco dyes include a colorant, an organic acid and a solvent. At lower temperatures, the solvent remains in a solid state, keeping the colorant and acid in close proximity to each other, resulting in that the leuco dye reflects light and creates color. As the solvent warms, the colorant and the acid separate and there is no visible color, which in turn exposes the underlying inks.

The temperature-dependent color changing material 335, such as thermochromic ink 335, may be mixed in with the material, such as plastic or polymer, used to fabricate the socket 330. For example, the material generally used to fabricate the socket 330 and the temperature-dependent color changing material 335 are mixed together prior to forming the socket 330, such as within a mold. Hence, the temperature-dependent color changing material 335 is uniformly mixed into the socket 330 and is inherently a part of the socket 330. In another exemplary embodiment, the temperature-dependent color changing material 335 is formed into a paint which is then later applied to the outer surface of the socket 330, for example, and not limited to, brushing or spraying. In yet another exemplary embodiment, the temperature-dependent color changing material 335 is formed into a tape, or similar type component, such that the tape that includes the temperature-dependent color changing material 335 is adhesively coupled to the outer surface of the socket 330. In each of the exemplary embodiments described above, the temperature-dependent color changing material 335 changes color as the temperature of the socket 330 changes.

Figure 4A:
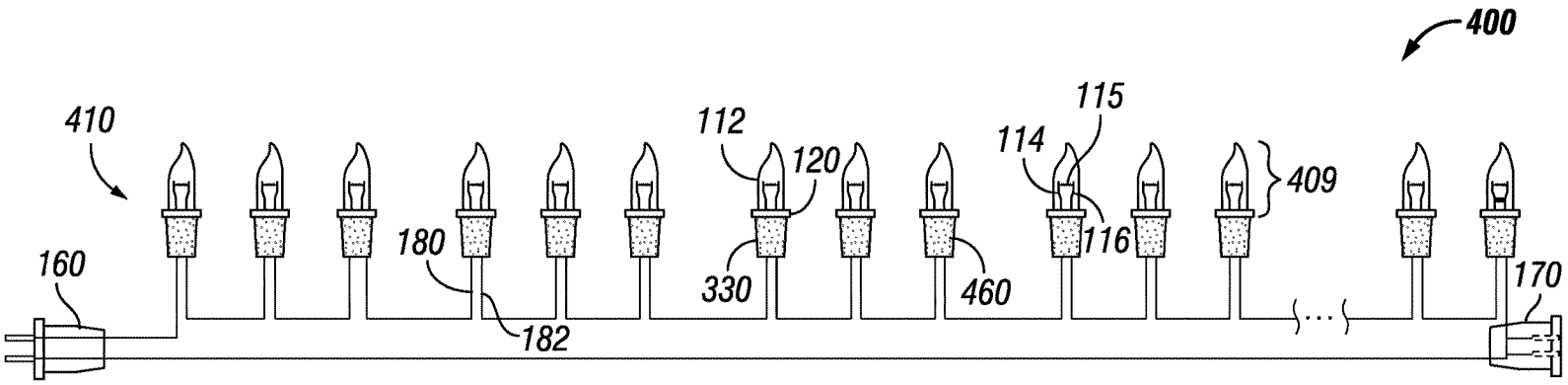
FIG. 4A is a schematic view of an ornamental light string having a plurality of lamps coupled in series with one another and wherein the light string is not coupled to a power source and the sockets comprise thermochromic ink in accordance with an exemplary embodiment of the present invention.

The socket 330, when the ornamental light string 300 is not coupled to a power source (not shown), is a first color 460 (FIG. 4A), i.e. when at room temperature. The first color 460 (FIG. 4A) is black, green, white, or some other desired color. However, the socket 330 changes to a second color 464 (FIG. 4B) when the ornamental light string 300 is coupled to a power source (not shown) and the filament 115 associated with that socket 330 is energized and lit. The filament 115 heats up thereby causing the socket 330 to also heat up and undergo a temperature change on its outer surface. This increase in temperature of the socket 330 causes the thermochromic ink 335 of the socket 330 to change colors. The second color 464 (FIG. 4B) is different than the first color 460 (FIG. 4A) and is orange according to some exemplary embodiments. However, in other exemplary embodiments, this second color 464 (FIG. 4B) is a different color, but still different than the first color 460 (FIG. 4A). In the event that the temperature of the socket 330 is at an intermediate temperature, a temperature between room temperature and the temperature at which the lamp 310 is lit, the socket 330 is a third color 468 (FIG. 4C). This occurs when current passes through the socket 330 but the lamp associated with that socket 330 is not lit. The color change that the socket 330 undergoes allows a user to visibly identify which bulb 309 requires replacement.

FIG. 4A is a schematic view of an ornamental light string 400 having a plurality of lamps 410 coupled in series with one another and wherein the light string 400 is not coupled to a power source (not shown) and the sockets 330 comprise thermochromic ink 335 (FIG. 3) in accordance with an exemplary embodiment of the present invention. Although thermochromic ink 335 (FIG. 3) is used in the sockets 330 in the exemplary embodiment, other exemplary embodiments use any temperature-dependent color changing material 335 in or on the socket 330 as mentioned above with respect to FIG. 3. The ornamental light string 400 is similar to the ornamental light string 100 (FIGS. 1A-1C) except that the ornamental light string 400 includes sockets 330 in lieu of sockets 130 (FIG. 1A). Socket 330 is described in detail with respect to FIG. 3.

Briefly, the ornamental light string 400 includes a plug 160 at one end, a receptacle 170 at the opposing end, and a plurality of lamps 410 therebetween, each electrically coupled to one another in series arrangement by two insulated wires 180, 182. Each lamp 410 includes a bulb 409, which includes a translucent cover 112 and a holder 120, and a socket 330. The translucent cover 112 encapsulates a first Dumet wire 114, a second Dumet wire 116, and a filament 115 extending from the end of the first Dumet wire 114 to the end of the second Dumet wire 116.

The details on the electrical connectivity from the insulated wires 180, 182 to the filament 115 is detailed with respect to FIG. 3. Although FIG. 3 illustrates and details one example for providing the electrical connectivity that is applicable for each lamp 410, the details of the electrical connectivity may be different in other exemplary embodiments and the description with respect to the electrical connectivity in accordance with FIG. 3 is not to be limiting in any respect.

According to FIG. 4A, the ornamental light string 400 is not coupled to a power source (not shown) and therefore none of the filaments 115 are energized and hence none of the lamps 410 are lit. The sockets 330 are all a first color 460. According to some exemplary embodiments, the first color 460 is a black color, green color or a white color, however, the first color 460 may be any other color.

Figure 4B:
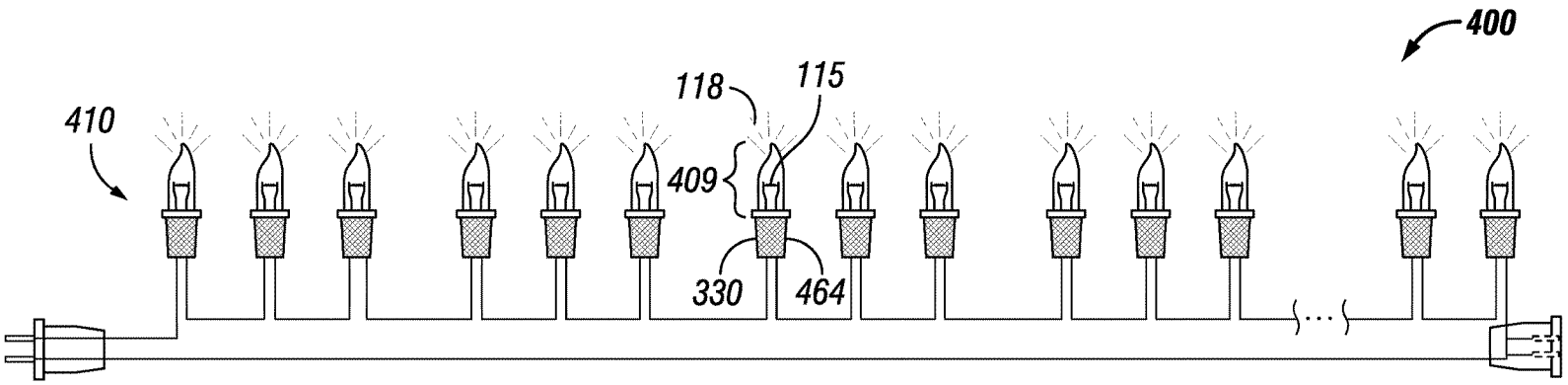
FIG. 4B is a schematic view of the ornamental light string of FIG. 4A wherein the light string is coupled to a power source in accordance with an exemplary embodiment of the present invention.
Figure 4C:
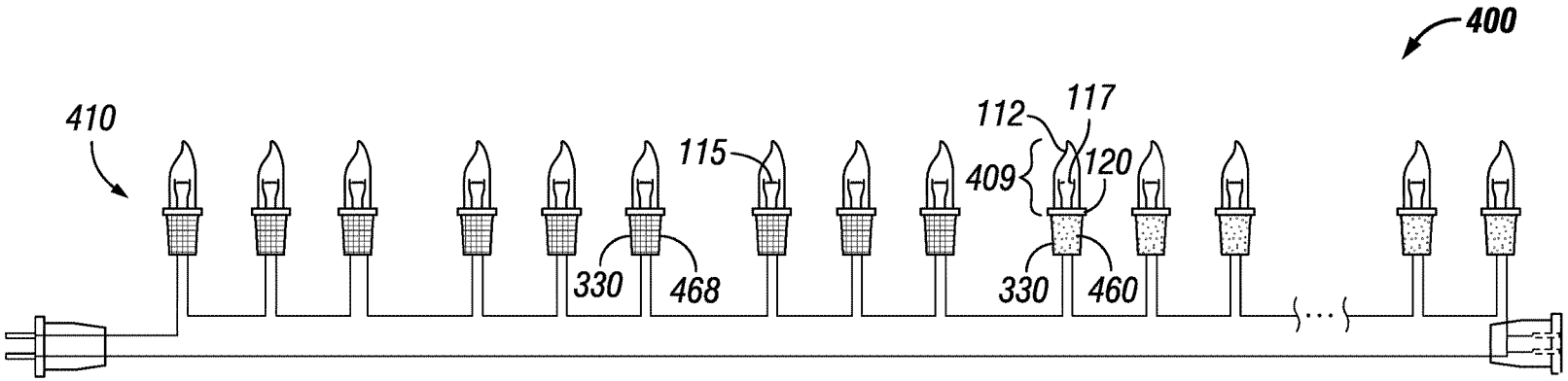
FIG. 4C is a schematic view of the ornamental light string of FIG. 4A wherein a broken filament in one of the bulbs of the light string is present and wherein the light string is coupled to a power source in accordance with an exemplary embodiment of the present invention.

FIG. 4B is a schematic view of the ornamental light string 400 of FIG. 4A wherein the light string 400 is coupled to a power source (not shown) in accordance with an exemplary embodiment of the present invention. According to FIG. 4B, all filaments 115 within each bulb 409 are working properly. According to FIG. 4B, the light string 400 is electrically coupled to the power source (not shown) and each of the filaments 115 within each of the bulbs 409 are energized, thereby causing each lamp 410 to be lit 118. The sockets 330 are heated up and change color from the first color 460 (FIG. 4A) to a second color 464 once the sockets 330 have reached a constant temperature.

FIG. 4C is a schematic view of the ornamental light string 400 of FIG. 4A wherein a broken filament 117 in one of the bulbs 409 of the light string 400 is present and wherein the light string 400 is coupled to a power source (not shown) in accordance with an exemplary embodiment of the present invention. According to FIG. 4C, all filaments 115 within each bulb 409 are working properly except for the broken filament 117 in one of the bulbs 409. According to FIG. 4C, the light string 400 is electrically coupled to a power source (not shown) and each of the filaments 115 along with the broken filament 117 are not energized since the electrical circuit is broken at the point of the broken filament 117. The current is not able to pass through to the filaments 115 positioned downstream of the broken filament 117. In particular, the current flows through each filament 115 positioned upstream of the broken filament 117, but does not flow through the broken filament 117 or any of the filaments 115 positioned downstream of the broken filament 117. Since the circuit is broken, none of the lamps 410 are lit. Since the current still flows through the lamps 410 positioned upstream of the broken filament 117 and those lamps 410 are not lit, the sockets 330 upstream of the broken filament 117 is exposed to some heat produced from the flowing current and therefore changes color to a third color 468. The temperature at these sockets 330 positioned upstream of the broken filament 117 is an intermediate temperature, a temperature between room temperature and the temperature at which the lamp 410 is lit 118 (FIG. 4B). Further, the current does not flow through the lamp 410 having the broken filament 117 nor does it flow through the lamps 410 positioned downstream of the lamp 410 having the broken filament 117, and thus all of these lamps 410 are not lit. Therefore, the sockets 330 of the lamp 410 having the broken filament 117 and of the lamps 410 positioned downstream of the broken filament 117 eventually return back to room temperature and are back to the first color 460. It is the bulb 409, which includes the transparent cover 112 and the holder 120, that is associated with the first socket 330 that is at the first color 460 that requires replacement. Hence, one can visually determine which lamp 410 has the broken filament 117 and quickly and easily replace that bulb 409.

Figure 5A:
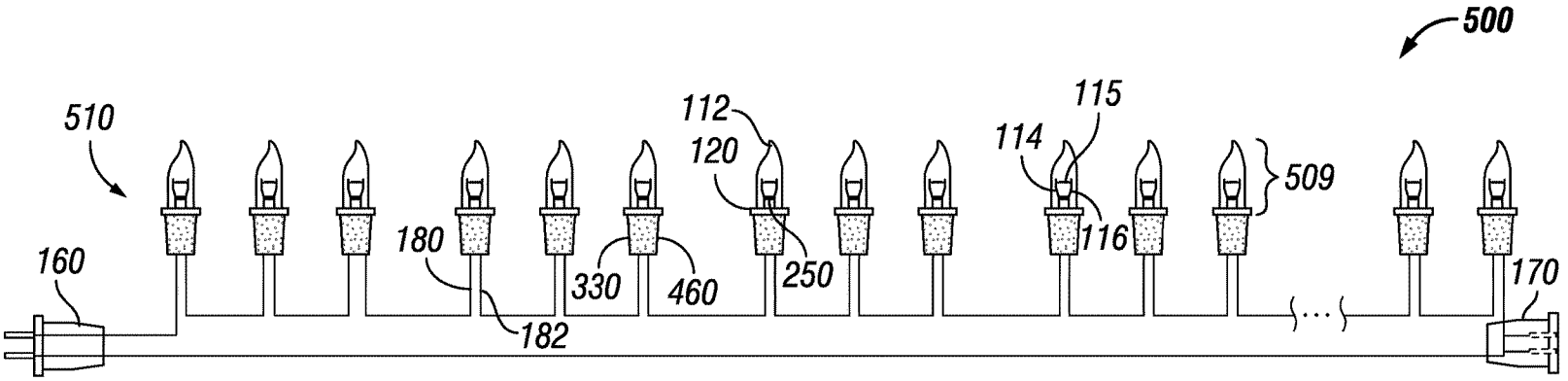
FIG. 5A is a schematic view of an ornamental light string having a plurality of lamps coupled in series with one another wherein each lamp includes a shunting device within each bulb and wherein the light string is not coupled to a power source and the sockets comprise thermochromic ink in accordance with an exemplary embodiment of the present invention.

FIG. 5A is a schematic view of an ornamental light string 500 having a plurality of lamps 510 coupled in series with one another wherein each lamp 510 includes a shunting device 250 within each bulb 509 and wherein the light string 500 is not coupled to a power source (not shown) and the sockets 330 comprise thermochromic ink 335 (FIG. 3) in accordance with an exemplary embodiment of the present invention. Although thermochromic ink 335 (FIG. 3) is used in the sockets 330 in the exemplary embodiment, other exemplary embodiments use any temperature-dependent color changing material 335 (FIG. 3) in or on the socket 330 as mentioned above with respect to FIG. 3. The ornamental light string 500 is similar to the ornamental light string 200 (FIGS. 2A-2D) except that the ornamental light string 500 includes sockets 330 in lieu of sockets 130 (FIG. 1A). Socket 330 is described in detail with respect to FIG. 3.

Briefly, the ornamental light string 500 includes a plug 160 at one end, a receptacle 170 at the opposing end, and a plurality of lamps 510 therebetween, each electrically coupled to one another in series arrangement by two insulated wires 180, 182. Each lamp 510 includes a bulb 509, which includes a translucent cover 112 and a holder 120, and a socket 330. The translucent cover 112 encapsulates a first Dumet wire 114, a second Dumet wire 116, a filament 115 extending from the end of the first Dumet wire 114 to the end of the second Dumet wire 116, and a shunting device 250 also extending from the first Dumet wire 114 to the second Dumet wire 116 such that the shunting device 250 is parallel to the filament 115 and is exposed to the electrical current prior to the filament 115 within that bulb 509.

The details on the electrical connectivity from the insulated wires 180, 182 to the filament 115 is detailed with respect to FIG. 3. Although FIG. 3 illustrates and details one example for providing the electrical connectivity that is applicable for each lamp 510, the details of the electrical connectivity may be different in other exemplary embodiments and the description with respect to the electrical connectivity in accordance with FIG. 3 is not to be limiting in any respect.

According to FIG. 5A, the ornamental light string 500 is not coupled to a power source (not shown) and therefore none of the filaments 115 are energized and hence none of the lamps 510 are lit. The sockets 330 are all a first color 460. According to some exemplary embodiments, the first color 460 is a black color, green color or a white color, however, the first color 460 may be any other color.

Figure 5B:
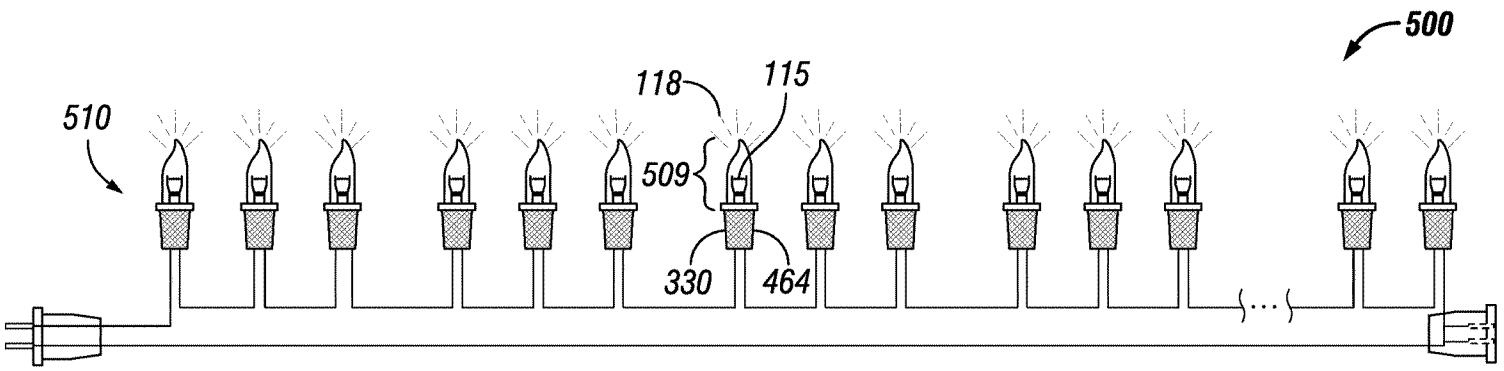
FIG. 5B is a schematic view of the ornamental light string of FIG. 5A wherein the light string is coupled to a power source in accordance with an exemplary embodiment of the present invention.

FIG. 5B is a schematic view of the ornamental light string 500 of FIG. 5A wherein the light string 500 is coupled to a power source (not shown) in accordance with an exemplary embodiment of the present invention. According to FIG. 5B, all filaments 115 within each bulb 509 are working properly. According to FIG. 5B, the light string 500 is electrically coupled to the power source (not shown) and each of the filaments 115 within each of the bulbs 509 are energized, thereby causing each lamp 510 to be lit 118. The sockets 330 are heated up and change color from the first color 460 (FIG. 5A) to a second color 464 once the sockets 330 have reached a constant temperature.

Figure 5C:
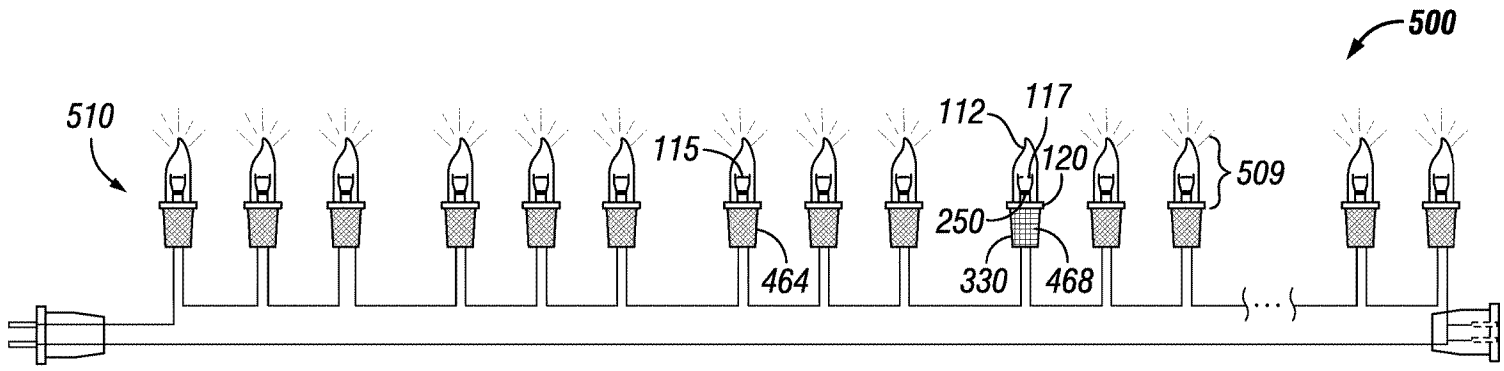
FIG. 5C is a schematic view of the ornamental light string of FIG. 5A wherein a broken filament in one of the bulbs of the light string is present and the shunting device within that bulb having the broken filament is operable and wherein the light string is coupled to a power source in accordance with an exemplary embodiment of the present invention.

FIG. 5C is a schematic view of the ornamental light string 500 of FIG. 5A wherein a broken filament 117 in one of the bulbs 509 of the light string 500 is present and the shunting device 250 within that bulb 509 having the broken filament 117 is operable and wherein the light string 500 is coupled to a power source (not shown) in accordance with an exemplary embodiment of the present invention. According to FIG. 5C, all filaments 115 within each bulb 509 are working properly except for the broken filament 117 in one of the bulbs 509. According to FIG. 5C, the light string 500 is electrically coupled to a power source (not shown) and each of the filaments 115, except for the broken filament 117, are energized since the electrical circuit is complete due to the shunting device 250 being operable within the bulb 509 having the broken filament 117. The current is able to pass through to the filaments 115 positioned upstream of the broken filament 117. Once at the lamp 510 having the broken filament 117, although the current is not able to pass through the broken filament 117, the electrical current is able to by-pass the broken filament 117 via the shunting device 250 within the bulb 509 having the broken filament 117. The current is then able to flow through each filament 115 positioned downstream of the broken filament 117. Since the circuit is complete due to the shunting device 250 being operable within the lamp 510 having the broken filament 117, all of the lamps 510 are lit except for the lamp 510 having the broken filament 117. Hence, all the sockets 330 are heated up and are at the second color 464 once the sockets 330 have reached a constant temperature, except for socket 330 having the broken filament 117. The socket 330 having the broken filament 117 is at the third color 468 since current is still passing through that socket 330 even though the lamp 510 associated with that socket 330 is not lit. According to the light string 500, it would be easy to determine which lamp 510 has the broken filament 117 and requires replacement of the bulb 509, which includes translucent cover 112 and holder 120, due to the lamp 510 with the broken filament 117 not being lit and the associated socket 330 undergoing a color change that is different than the second color 464, but only when the shunting device 250 is operational. Hence, one can visually determine which lamp 510 has the broken filament 117 and quickly and easily replace that bulb 509. However, in most cases, shunting devices 250 do not operate as intended or often fail. This scenario is described in further detail with respect to FIG. 5D below.

Figure 5D:
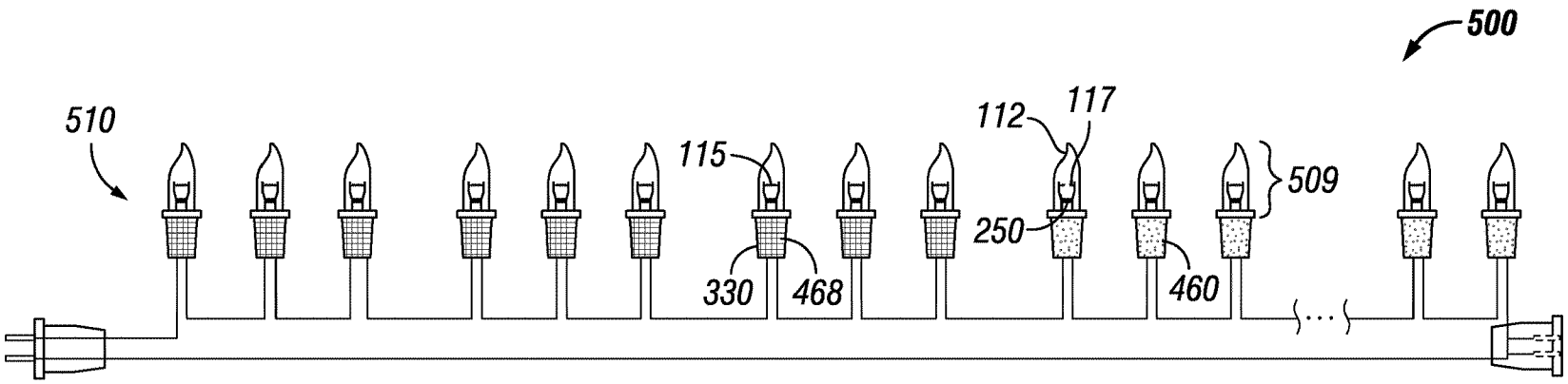
FIG. 5D is a schematic view of the ornamental light string of FIG. 5A wherein a broken filament in one of the bulbs of the light string is present and the shunting device within that bulb having the broken filament is inoperable and wherein the light string is coupled to a power source in accordance with an exemplary embodiment of the present invention.

FIG. 5D is a schematic view of the ornamental light string 500 of FIG. 5A wherein a broken filament 117 in one of the bulbs 509 of the light string 500 is present and the shunting device 250 within that bulb 509 having the broken filament 117 is inoperable and wherein the light string 500 is coupled to a power source (not shown) in accordance with an exemplary embodiment of the present invention. According to FIG. 5D, all filaments 115 within each bulb 509 are working properly except for the broken filament 117 in one of the bulbs 509. According to FIG. 5D, the light string 500 is electrically coupled to a power source (not shown) and each of the filaments 115 along with the broken filament 117 are not energized since the electrical circuit is broken at the point of the broken filament 117 and the inoperable shunting device 250, which are both located within the same lamp 510. The current is not able to pass through to the filaments 115 positioned downstream of the broken filament 117. In particular, the current flows through each filament 115 positioned upstream of the broken filament 117, but does not flow through the broken filament 117 or any of the filaments 115 positioned downstream of the broken filament 117. Since the circuit is broken, none of the lamps 510 are lit. Since the current still flows through the lamps 510 positioned upstream of the broken filament 117 and those lamps 510 are not lit, the sockets 330 upstream of the broken filament 117 is exposed to some heat produced from the flowing current and therefore changes color to a third color 468. The temperature at these sockets 330 positioned upstream of the broken filament 117 is an intermediate temperature, a temperature between room temperature and the temperature at which the lamp 510 is lit 118 (FIG. 5B). Further, the current does not flow through the lamp 510 having the broken filament 117 nor does it flow through the lamps 510 positioned downstream of the lamp 510 having the broken filament 117, and thus all of these lamps 510 are not lit. The socket 330 of the lamp 510 having the broken filament 117 and of the lamps 510 positioned downstream of the broken filament 117 eventually return back to room temperature and are back to the first color 460. It is the bulb 509 that is associated with the first socket 330 that is at the first color 460 that requires replacement. Hence, one can visually determine which lamp 510 has the broken filament 117 and quickly and easily replace that bulb 509, which includes translucent cover 112 and holder 120.

Although some exemplary embodiments have been disclosed herein, other exemplary embodiments that do not depart from the scope and spirit of the present embodiments are to be included herein. For example, although the bulbs 309, 409, 509 have been described as including a filament to produce light incandescently, light may be produced by other bulb types, such as LEDs. LEDs also produce heat which would cause the sockets of the present exemplary embodiments to undergo the appropriate color changes as disclosed herein. Further, in other exemplary embodiments, at least a portion of the holder 120 that remains exposed once the holder 120 is inserted into the socket 130, 330 includes the temperature-dependent color changing material 335, such as thermochromic ink 335. This would allow at least that portion of the holder 120 to change colors as described herein to allow a user to determine which bulb 309, 409, 509 has the broken filament 117.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An ornamental light string, comprising:
- a plug positioned at one end of a light string;
- a receptacle positioned at an opposing end of the light string;
- a wire extending from and electrically coupling the plug to the receptacle; and
- a plurality of lamps positioned along and electrically coupled to the wire, at least a portion of the plurality of lamps being arranged in series arrangement along the wire, wherein each lamp comprises:
  - a bulb comprising a translucent cover, a holder coupled to the translucent cover at one end, and a light source positioned within the translucent cover and electrically coupled to the wire, the light source capable of emitting light through the translucent cover; and
  - a socket having a cavity extending from a top end towards a bottom end, the socket being coupled to the bulb, wherein at least a portion of the holder is removably positioned within the cavity, the socket comprising a temperature-dependent color changing material being at least partially exposed on the outer surface of the socket, and wherein the temperature-dependent color changing material visibly changes color on at least the outer surface of the socket when the temperature of the socket changes.

2. The ornamental light string of claim 1, wherein the temperature-dependent color changing material comprises a thermochromic ink.

3. The ornamental light string of claim 2, wherein the thermochromic ink comprises at least one of thermochromatic liquid crystals and leuco dyes.

4. The ornamental light string of claim 1, wherein the temperature-dependent color changing material is mixed into a non-conductive material prior to forming the socket.

5. The ornamental light string of claim 1, wherein the temperature-dependent color changing material is painted onto the outer surface of the socket.

6. The ornamental light string of claim 1, wherein the temperature-dependent color changing material is adhesively applied onto the outer surface of the socket.

7. The ornamental light string of claim 1, wherein each lamp further comprises a shunting device positioned within the translucent cover and electrically coupled to the wire and arranged in parallel with the light source.

8. The ornamental light string of claim 1, wherein the outer surface of the socket is at a first color when at room temperature, the outer surface of the socket is at a second color when the light source is operating and the temperature has stabilized, and the outer surface of the socket is at a third color when the light source has failed and electrical current continues to pass through the socket.

9. A method for assembling an ornamental light string, comprising:

providing a plug and a receptacle;

electrically connecting the plug to the receptacle using an insulated wire;

electrically connecting a plurality of lamps along the insulated wire, at least a portion of the plurality of lamps being positioned in a series arrangement with one another, wherein each lamp comprises:

a socket having a cavity extending from a top end towards a bottom end, the socket comprising a temperature-dependent color changing material being at least partially exposed on the outer surface of the socket, a first electrical terminal and a second electrical terminal positioned along an interior surface of the socket within the cavity, each of the first and second electrical terminals being electrically coupled to the insulated wire; and a bulb coupled to the socket, the bulb comprising:

a translucent cover;

a holder coupled to the translucent cover at one end; and a light source positioned within the translucent cover and electrically coupled to the first and second electrical terminals when at least a portion of the holder is removably positioned within the cavity and coupled to the socket, the light source capable of emitting light through the translucent cover;

wherein the temperature-dependent color changing material visibly changes color on at least the outer surface of the socket when the temperature of the socket changes.

10. The method of claim 9, wherein the temperature-dependent color changing material comprises a thermochromic ink.

11. The method of claim 9, wherein each bulb further comprises a shunting device positioned within the translucent cover and electrically coupled to the first and second electrical terminals and arranged in parallel with the light source.

12. The method of claim 9, wherein the outer surface of the socket is at a first color when at room temperature, the outer surface of the socket is at a second color when the light source is operating and the temperature has stabilized, and the outer surface of the socket is at a third color when the light source has failed and electrical current continues to pass through the socket.

* * * * *